US009241570B2

(12) United States Patent
Jones et al.

(10) Patent No.: US 9,241,570 B2
(45) Date of Patent: Jan. 26, 2016

(54) TILT MECHANISM FOR A CHAIR AND CHAIR

(75) Inventors: Mark Grant Jones, Lancashire (GB); Alessandro Slongo, Mogliano Veneto (IT)

(73) Assignee: L&P Property Management Company, South Gate, CA (US)

( * ) Notice: Subject to any disclaimer, the term of this patent is extended or adjusted under 35 U.S.C. 154(b) by 372 days.

(21) Appl. No.: 13/818,866

(22) PCT Filed: Aug. 25, 2010

(86) PCT No.: PCT/EP2010/005215
§ 371 (c)(1),
(2), (4) Date: Apr. 14, 2014

(87) PCT Pub. No.: WO2012/025134
PCT Pub. Date: Mar. 1, 2012

(65) Prior Publication Data

US 2013/0200674 A1 Aug. 8, 2013

(51) Int. Cl.
*A47C 1/024* (2006.01)
*A47C 3/026* (2006.01)
*A47C 1/032* (2006.01)

(52) U.S. Cl.
CPC ..... *A47C 1/032* (2013.01); *A47C 1/03255* (2013.01); *A47C 1/03294* (2013.01)

(58) Field of Classification Search
USPC ..... 297/285–299, 300.1–301.7
See application file for complete search history.

(56) References Cited

U.S. PATENT DOCUMENTS

| | | | |
|---|---|---|---|
| 4,595,236 | A | 6/1986 | Rizzoli et al. |
| 4,720,142 | A | 1/1988 | Holdredge et al. |
| 4,796,950 | A | 1/1989 | Mrotz et al. |
| 5,228,748 | A | 7/1993 | Neumuller et al. |
| 5,333,368 | A | 8/1994 | Kriener |
| 5,340,194 | A | 8/1994 | Neumuller |

(Continued)

FOREIGN PATENT DOCUMENTS

| | | | |
|---|---|---|---|
| CN | 1074361 | A | 7/1993 |
| CN | 1684854 | A | 10/2005 |

(Continued)

OTHER PUBLICATIONS

ISR, mailed Feb. 18, 2011, in PCT/EP2010/005215, filed Aug. 25, 2010, 10 pp.

(Continued)

*Primary Examiner* — Rodney B White
(74) *Attorney, Agent, or Firm* — Shook, Hardy & Bacon, LLP

(57) ABSTRACT

A tilt mechanism (10) for a chair comprises a base (11), a first support (12) configured to support a chair seat and a second support (13) configured to support a chair back. The second support (13) is pivotably coupled to the base (11). A first coupling mechanism (41) couples the first support (12) with the base (11) and includes a first pin (40) slideably supported in a first linear guide slot (20). A second coupling mechanism (42) couples the second support (13) with the first support (12) and includes a second pin (44) slideably supported in a second linear guide slot (36). When the second support (13) pivots relative to the base (11), the first pin (40) is caused to be displaced along the first linear guide slot (20) and the second pin (44) is caused to be displaced along the second linear guide slot (36).

17 Claims, 6 Drawing Sheets

(56) References Cited

U.S. PATENT DOCUMENTS

| | | | | |
|---|---|---|---|---|
| 5,354,120 | A | 10/1994 | Voelkle | |
| 5,397,165 | A * | 3/1995 | Grin et al. | 297/300.5 |
| 5,664,834 | A | 9/1997 | Hsu | |
| 6,059,363 | A | 5/2000 | Roslund et al. | |
| 6,419,320 | B1 | 7/2002 | Wang | |
| 6,447,063 | B1 | 9/2002 | Beggs | |
| 6,945,602 | B2 | 9/2005 | Fookes et al. | |
| 7,300,109 | B2 | 11/2007 | Hoffman et al. | |
| 7,614,697 | B1 | 11/2009 | Lai | |
| 2002/0195856 | A1 | 12/2002 | Caruso et al. | |
| 2006/0202529 | A1 * | 9/2006 | Johnson et al. | 297/286 |
| 2008/0054700 | A1 | 3/2008 | Meidan | |
| 2009/0218864 | A1 * | 9/2009 | Parker et al. | 297/300.2 |
| 2009/0267394 | A1 | 10/2009 | Bock | |
| 2012/0007400 | A1 * | 1/2012 | Behar et al. | 297/285 X |
| 2012/0086251 | A1 * | 4/2012 | Parker et al. | 297/285 |

FOREIGN PATENT DOCUMENTS

| | | | |
|---|---|---|---|
| DE | 9109184 | U1 | 10/1991 |
| EP | 1172049 | A1 | 1/2002 |
| TW | 200950726 | A | 12/2009 |
| WO | 2010097818 | A1 | 9/2010 |
| WO | 2010103554 | A1 | 9/2010 |
| WO | 2013004253 | A1 | 1/2013 |

OTHER PUBLICATIONS

International Search Report and Written Opinion dated Mar. 17, 2014 in Application No. PCT/EP2014/053346, 7 pages.

* cited by examiner

TILT MECHANISM FOR A CHAIR AND CHAIR

CROSS-REFERENCE TO RELATED APPLICATIONS

This application claims priority to PCT Application No. PCT/EP2010/005215, titled "Tilt Mechanism For a Chair and Chair," filed Aug. 25, 2010, which is expressly incorporated by reference herein in its entirety.

FIELD OF THE INVENTION

The invention relates to a tilt mechanism for a chair and a chair. The invention relates in particular to a tilt mechanism for a chair having a chair seat and a chair back, which tilt mechanism allows the chair seat to be displaced and the chair back to be reclined in a coordinated manner.

BACKGROUND OF THE INVENTION

For a wide variety of applications, chairs are nowadays provided with features which provide enhanced comfort to the person using the chair. For illustration, office-type chairs are commonly utilized in modern working environments to provide an occupant with a level of comfort while performing certain tasks that require a person to be in a seated position for an extended period of time. One common configuration for such a chair includes a mobile chair base assembly to allow the chair to roll across a floor and a pedestal column supporting the superstructure of the chair. The superstructure may include components which enable the user to adjust certain settings of the chair and to facilitate recline or "tilt" of the chair superstructure, including the seat and back of the chair. This basic chair configuration allows users to change their sitting position in the chair as desired, such that fatigue may be minimized during long sitting periods.

In recent years, chair designs have implemented a feature where a chair back and seat both move simultaneously during a tilting or rearwardly reclining motion of the chair back. The chair seat may also tilt in this process or may be displaced otherwise relative to the chair base. The combined movement of the chair back and seat in these designs results in some level of improvement for the occupant through a range of tilting motions over a conventional "static" chair without coordinated back and seat movement.

Various configurations may be realized to implement such a coordinated motion of the chair back and chair seat. For illustration, a back support supporting the chair back may be coupled to a seat support supporting the chair seat via a pivot coupling.

Such a pivot coupling may restrict the movement of the rear portion of the seat to a radial movement. Such a purely radial movement may give rise to undesired conditions, such as "shirt shear" or "bridging" conditions. If a shirt sear occurs, the occupant's shirt may be untucked, which is undesirable. When the bridging condition occurs, the lower portion of the chair back falls away from the occupant during recline. In such a condition, the occupant's lumbar region may be largely unsupported by the chair back.

More complex configurations of tilt mechanisms may be realized, in order to make it less likely for undesired conditions to occur during recline. For illustration, the reclining mechanism may be provided with an additional link member which is coupled to the seat support through a pivot connection and to the back support through another pivot connection. While more complex relative movements of the chair seat and chair back can be defined using such configurations, they may lead to increased complexity and, thus, costs of the tilt mechanism. Further, considerable re-design may be required to adapt such a tilt mechanism to various types of chairs.

It may also be desirable to implement a chair tilt mechanism which can be easily adapted to different chair requirements. Different types of chairs may impose different constraints on the mechanism. For illustration, the chair tilt mechanism should be able to move between the zero tilt and the full tilt position, while not moving the occupant's center of gravity relative to the chair base assembly so much that an overbalancing or tipping occurs. The shift in center of gravity which is still acceptable will depend on the configuration of the chair base assembly. Complex configurations of chair superstructures, for example of the type using additional link members articulated to both the seat support and the backrest support, may be complicated to re-design so as to accommodate the design constraints imposed by different types of chairs.

BRIEF SUMMARY OF THE INVENTION

There is a continued need in the art for a chair tilt mechanism and a chair which address some of the above needs. In particular, there is a continued need in the art for a chair tilt mechanism which does not restrict the movement of a seat support to a purely radial movement. There is also a continued need in the art for a chair tilt mechanism which allows the characteristics of the chair tilt mechanism, such as the weight compensation affect, to be adapted to various requirements.

According to an embodiment, a tilt mechanism is provided. The tilt mechanism comprises a base, a first support configured to support a chair seat and displaceably mounted to the base, and a second support configured to support a chair back and pivotably coupled to the base. The tilt mechanism further comprises a first coupling mechanism coupling the first support to the base and comprising a first linear guide slot and a first pin slideably supported in the first linear guide slot. The first linear guide slot may be provided on one of the base and the first support, and the first pin may be attached to the other one of the base and the first support. The tilt mechanism further comprises a second coupling mechanism coupling the second support to the first support and comprising a second linear guide slot and a second pin slideably supported in the second linear guide slot. The second linear guide slot may be provided on one of the first support and the second support, and the second pin may be attached to the other one of the first support and the second support. The tilt mechanism may be configured such that pivoting the second support relative to the base causes the first pin to be displaced along the first linear guide slot and the second pin to be displaced along the second linear guide slot.

In the tilt mechanism of the embodiment, the second coupling mechanism allows the second pin to travel along the second guide slot. This provides enhanced flexibility in defining the movement of the rear end of the first support. The characteristics of the tilt mechanism may be altered by appropriately selecting the slope of the first and second linear guide slots during manufacture.

According to another embodiment, a chair is provided. The chair comprises a chair base assembly, a chair seat, a chair back and a tilt mechanism. The tilt mechanism has a base coupled to the chair base assembly, a first support supporting the chair seat and a second support supporting the chair back. The first support is displaceably mounted to the base. A first coupling mechanism coupling the first support to the base comprises a first pin slideably supported in a first linear guide slot. The second support is pivotably coupled to the base. A second coupling mechanism coupling the second support to the first support comprises a second pin slideably supported in a second linear guide slot. When the chair back is reclined, the first pin travels along the first linear guide slot and the second pin travels along the second linear guide slot.

The tilt mechanism and chair according to embodiments may be utilized for various applications in which a coordinated reclining motion of the chair back and motion of the chair seat is desired. For illustration, the chair tilt mechanism may be utilized in an office chair.

Embodiments of the invention will be described with reference to the accompanying drawings.

Figure 1:
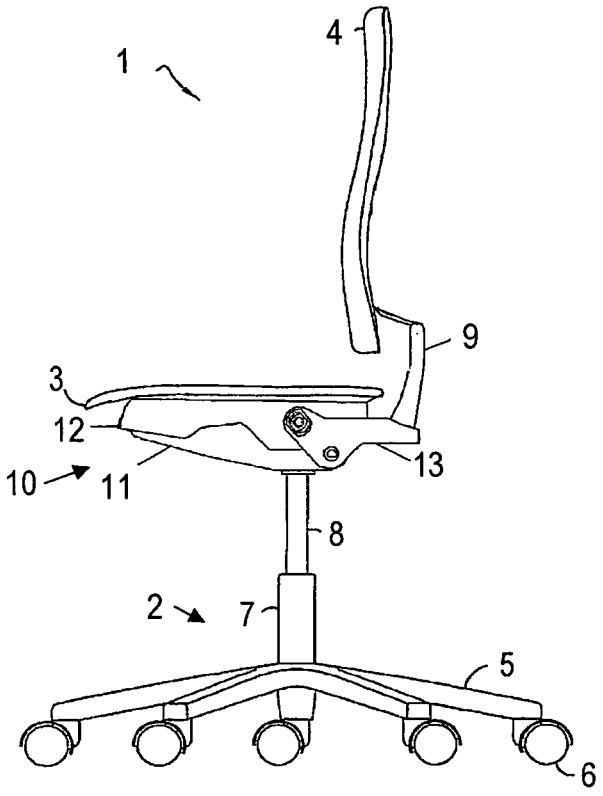
FIG. 1 is a schematic view of a chair having a chair tilt mechanism according to an embodiment.

Exemplary embodiments of the invention will be described with reference to the drawings. While some embodiments will be described in the context of specific fields of application, such as in the context of an office-type chair, the embodiments are not limited to this field of application. The features of the various embodiments may be combined with each other unless specifically stated otherwise.

According to embodiments, a tilt mechanism is provided which generally includes a base, a first support for supporting a chair seat and a second support for supporting a chair back. In use of the tilt mechanism, the chair seat may be fixedly mounted to the first support and the chair back may be fixedly mounted to the second support. The first support is displaceably mounted to the base. A first coupling mechanism coupling the first support to the base comprises a first pin slideably supported in a first linear guide slot. The second support is pivotably coupled to the base. A second coupling mechanism coupling the second support to the first support comprises a second pin slideably supported in a second linear guide slot. When the chair back is reclined, the first pin travels along the first linear guide slot and the second pin travels along the second linear guide slot.

The tilt mechanism may have a compact construction, with the first and second coupling mechanisms implemented in a structure disposed below the chair seat.

The first linear guide slot may be formed in a first plane and the second linear guide slot may be formed in a second plane extending parallel to the first plane. This allows the first and second coupling mechanisms to be arranged offset relative to each other in a lateral direction of the tilt mechanism. The second linear guide slot may be arranged to at least partially overlap with the first linear guide slot, when viewed in a direction perpendicular to the first plane, when the tilt mechanism is in a rest position and/or when the tilt mechanism is in a position corresponding to a fully reclined chair back. Thereby, a simple structure and compact design of the tilt mechanism may be attained.

The longitudinal axes of the first and second pins may be parallel to each other, for all tilt positions of the tilt mechanism. The base may have a side wall portion which extends transverse to the longitudinal axis of the first pin, with one of the first pin and the first linear guide slot being provided on the side wall portion of the base. The first support may have a side wall portion which extends transverse to the longitudinal axis of the first pin, with the other one of the first pin and the first linear guide slot being provided on the side wall portion of the first support. The second support may have a wing portion extending transverse to the longitudinal axis of the first pin, with one of the second pin and the second linear guide slot being provided on the wing portion of the second support. The side wall portion of the first support may at least partially overlap with the side wall portion of the base. The wing portion of the second support may at least partially overlap with the side wall portion of the base. This configuration allows the tilt mechanism to be configured in a housing-type structure. Additional adjustment functionalities may be incorporated into such a housing-type structure, while allowing the mechanism to be easily combined with the chair base assembly, chair seat and chair back to form a chair. Further, a compact design of the tilt mechanism may be attained.

The first linear guide slot may be provided on the base, and the first pin may be attached to the first support. The second linear guide slot may be provided on the second support, and the second pin may be attached to the second support. By attaching both the first pin and the second pin to the first support, a tilt mechanism which is easy to assemble may be attained.

The tilt mechanism may define a forward direction of the chair. When the tilt mechanism is in the zero-tilt state, one of the first and second linear guide slots may be sloped upwardly relative to the forward direction and the other one of the first and second linear guide slots may be sloped downwardly relative to the forward direction. This allows a movement of the second support to be realized such that the chair seat supported thereon is lifted and tilted when the chair back is reclined.

The first coupling mechanism may have a pair of first linear guide slots provided on opposing side walls of the base or first support. The second coupling mechanism may have a pair of second linear guide slots provided on opposing side walls of the first support or second support. Mechanical stability can thereby be enhanced.

FIG. 1 shows a chair 1 which includes a tilt mechanism 10 of an embodiment. The chair 1 is illustrated to be an office-type chair having a chair base assembly 2 and a superstructure. The superstructure includes a chair seat 3, a chair back 4 and components to interconnect the seat 3 with the back 4. The components, which will be described in more detail below, include a tilt mechanism for effecting a coordinated motion of the back 4 and the seat 3. The base assembly 2 includes a pedestal column 7, a number of support legs 5 extending radially from the column 7 and a corresponding number of castors 6 operably supported on the outer ends of the support legs 5. Additionally, a gas cylinder 8 or other lifting mechanism may be supported by the column 7 to enable the height of the seat 3, and thus of the chair superstructure, to be adjusted by an occupant.

It should be understood that the terms "forward", "rearward" and "lateral", as used herein, each have a particular meaning that is defined in relation to a flat support surface beneath the chair 1 (e.g., parallel to a floor on which castors 6 rest) and in relation to an occupant of the chair. For instance, the term "forward" refers to a direction moving away from the back 4 and in front of a chair occupant along an axis which extends parallel to such a flat support surface, while the term "rearward" refers to a direction opposite of the forward direction. The term "lateral" refers to a generally horizontal direction perpendicular to both the forward and rearward direction and extending parallel to the aforementioned flat support surface.

The chair 1 includes a tilt mechanism 10. Generally, the tilt mechanism 10 is operative to implement a coordinated motion of the seat 3 and of the back 4 when the back 4 is tilted. The tilt mechanism 10 includes a base 11 which, in the installed state of the tilt mechanism in which the tilt mechanism 10 is incorporated into a chair as illustrated in FIG. 1, is coupled to the pedestal column 7. The tilt mechanism 10 includes a seat support 12 which, in the installed state of the tilt mechanism 10, is directly coupled to the seat 3 and supports the seat 3 from below. The seat support 12 acts as first support which is displaceably mounted to the base 11. The seat 3 may be fixedly coupled to the seat support 11, such that a translational and/or rotational motion of the seat support 12 causes the seat 3 to move jointly with the seat support in a translational and/or rotational manner. The tilt mechanism 10 includes a back support 13 which, in the installed state of the tilt mechanism 10, is coupled to the back 4. The back 4 may be attached to the back support 13 using suitable connecting members, such as a bar 9 affixed to the back support 13. The bar 9 may be directly and rigidly attached to the back support 13. The back support 13 acts as a second support.

As will be described in more detail with reference to FIGS. 2-11, the tilt mechanism 10 is configured such that the back support 13 is pivotably coupled to the base 11, allowing the back support 13 to pivot relative to the base 11. The tilt mechanism 10 has a first coupling mechanism coupling the seat support 12 to the base 11. The first coupling mechanism includes a first linear guide slot and a first pin slideably supported therein. The first linear guide slot is formed on one of the base 11 and the seat support 12, and the first pin is fixed to the other one of the base 11 and the seat support 12. The tilt mechanism 10 has a second coupling mechanism coupling the seat support 12 to the back support 13. The second coupling mechanism includes a second linear guide slot and a second pin slideably supported therein. The second linear guide slot is formed on one of the seat support 12 and the back support 13, and the second pin is fixed to the other one of the seat support 12 and the back support 13.

When the back 4 is tilted, the second pin is driven along the longitudinal axis of the second guide slot. This forces the first pin to travel along the longitudinal axis of the first guide slot. When the back 4 is tilted, the seat support 12 is thereby displaced relative to the base 11 and, thus, relative to the chair base assembly 2, using the combination of first and second coupling mechanisms.

As used herein, the term "linear guide slot" refers to a slot having a linear center axis, extending linearly from one end of the slot to the opposite end of the slot along the slot longitudinal axis. The linear slot may respectively be formed as a cutout, i.e., a through slot, or as a blind slot.

The tilt mechanism 10 may include a suitable biasing device biasing the tilt mechanism into a position in which the back 4 is in its foremost position. This state, corresponding to the rest state of the tilt mechanism 10, will also be referred to as zero-tilt position. The tilt mechanism may also be configured to limit the reclining motion of the back 4. The state in which the mechanism prevents the back 4 from being reclined further will also be referred to as full-tilt state.

Configurations of the tilt mechanism according to embodiments will be described in more detail with reference to FIGS. 2-11.

Figure 2:
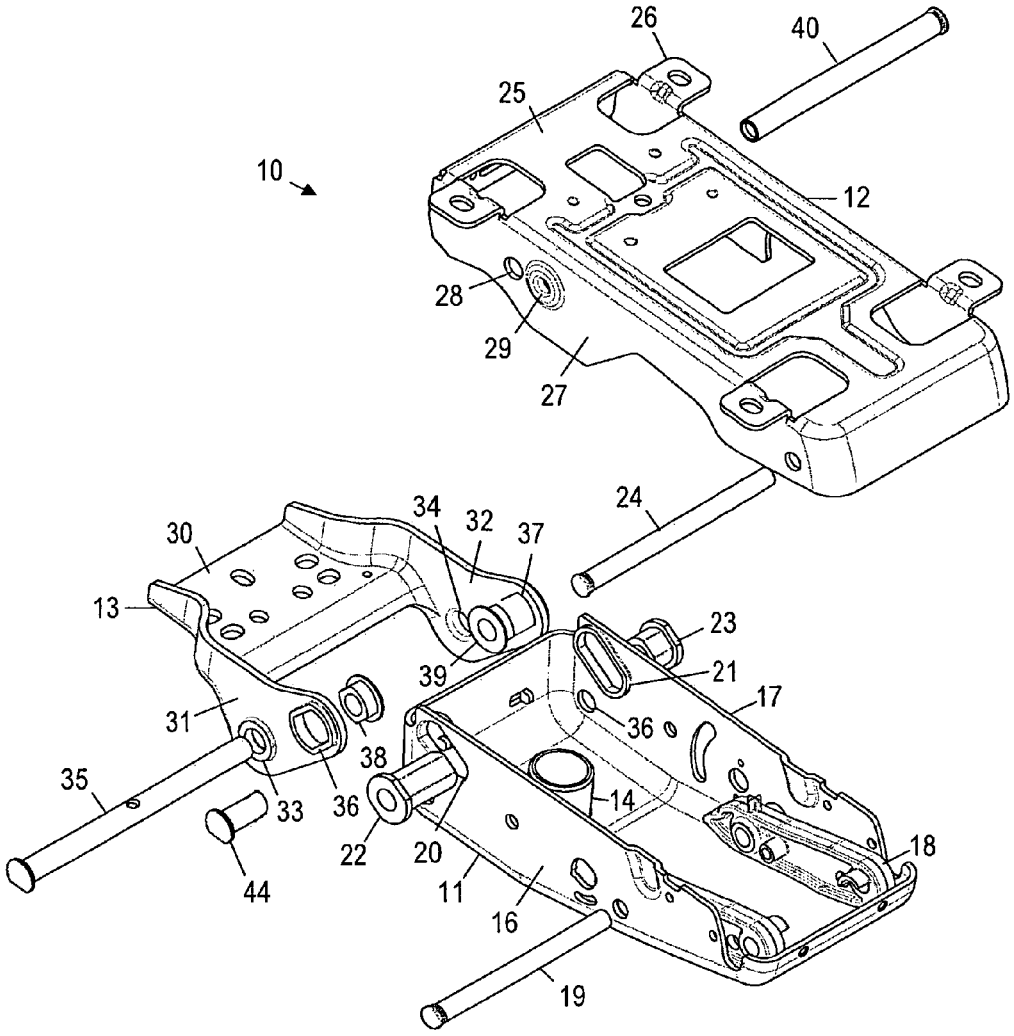
FIG. 2 is an exploded perspective view of a chair tilt mechanism according to an embodiment.

FIG. 2 is an exploded view of a tilt mechanism 10 according to an embodiment. The tilt mechanism 10 may be used to effect a coordinated motion of the chair seat and chair back.

The tilt mechanism 10 includes a base 11, a seat support 12, and a back support 13. The base 11 and the seat support 12, when mounted to each other, form a housing-type structure. Additional functional components may be housed in the interior of the housing defined by the base 11 and the seat support 12, such as a bias mechanism for biasing the tilt mechanism 10 into a rest position, corresponding to the zero-tilt position.

The base 11 generally has a U-shaped cross-section in a plane extending in the lateral direction of the tilt mechanism 10. The base 11 has a bottom wall, on which a coupling arrangement 14 for coupling the tilt mechanism 10 to a chair base assembly is formed. The coupling arrangement 14 may include a cylindrical receptacle configured to receive a pedestal column. From the bottom of the base 11, there extend two side walls 16 and 17. The side walls 16, 17 may be provided to extend in the forward-backward direction of the tilt mechanism 10. The side walls 16, 17 may be provided such that, when the tilt mechanism 10 is installed in a chair, the side walls 16, 17 of the base extend perpendicular to the horizontal plane defined as the plane on which the chair base assembly rests.

The seat support 12 is displaceably mounted to the base 11. The base 11 may include various types of mechanisms for implementing such a displaceable coupling. For illustration rather than limitation, an arrangement having a pair of links 18 is illustrated in FIG. 2. The links 18 are articulated to the base 11 via a pin 19 which extends across the base 11 in the lateral direction of the tilt mechanism 10. The links 18 are articulated to the seat support 12 via a pin 24 which extends across the seat support 12 in the lateral direction of the tilt mechanism 10. Alternative or additional components may be provided to define the movement of the forward end of the seat support 12 relative to the base 11. Examples for such components include sloping rails or flanges on which a front end of the seat support 12 abuts, or similar.

The base 11 is provided with first linear guide slots 20 and 21, which are formed in the side walls 16 and 17, respectively. The first linear guide slot 20 and 21, in combination with a first pin slideably supported therein, allows the seat support 12 to be displaced relative to the base 11, with the first pin sliding along the first guide slot 20 and 21, respectively. This first coupling will be described in more detail below.

The seat support 12 includes a top plate 25. The top plate 25 may be generally planar. Attachment portions 26 for fixedly attaching a chair seat to the seat support 12 are provided on the seat support 12. The seat support 12 includes a pair of side walls extending downwardly from the top plate 25. While only one side wall 27 can be seen in the exploded perspective view of FIG. 2, the seat support 12 is symmetric relative to its longitudinal center plane. I.e., the various features described with reference to the side wall 27 are correspondingly implemented in the other side wall (not shown in FIG. 2). The side walls 27 of the seat support 12 are arranged to extend generally parallel to the side walls 16 and 17 of the base 11. The side walls 27 of the seat support 12 remain parallel to the side walls 16 and 17 of the base 11 as the tilt mechanism 10 is actuated from the zero-tilt position to the full-tilt position.

Each side wall 27 of the seat support 12 has a plurality of through openings. A through opening 28 is provided for fixing a first pin to the seat support 12. The first pin is slideably supported in the first guide slot 20 of the base, as will be described in more detail below. Another through opening 29 is provided for fixing a second pin to the seat support 12. The second pin is slideably supported in a second guide slot formed in the back support 13.

The back support 13 has an attachment portion 30 for fixedly attaching the chair back. The back support 13 further has side wings 31 and 32, respectively. The side wings 31 and 32 are arranged to extend parallel to the side walls 16 and 17 of the base 11. The back support 13 is pivotably coupled to the base 11. A through opening 33 is formed in the side wing 31, and another through opening 34 is formed in the side wing 32. Corresponding through openings are provided in the side walls 16 and 17 of the base 11, respectively. Only the through opening 36 formed in the side wall 17 of the base is visible in FIG. 2. In the assembled state of the tilt mechanism 10, a pin 35 passes through the through opening 33 formed in the side wing 31 of the back support 13, the through openings 36 formed in the side walls 16 and 17 of the base 11, and the through opening 34 formed in the side wings 32 of the back support 13, thereby implementing a pivot coupling. The pin 35 may be fixed to the base 11.

The back support 13 is provided with second linear guide slots 36 and 37 formed in the side wings 31 and 32, respectively. The second linear guide slots 36 and 37, in combination with second pin(s) slideably supported therein, implement a second coupling mechanism which couples the seat support 12 to the back support 13.

The first and second coupling mechanisms will be described in more detail next.

In the assembled state of the tilt mechanism 10, the seat support 12 is coupled to the base 11 via a first coupling mechanism. A first pin 40 is fixed to the seat support 12.

The first pin 40 may be passed through the through opening 28 formed in the side wall 27 of the seat support 12. In the illustrated implementation, the first pin 40 has a length to extend across the width of the seat support 12, passing through a corresponding through opening in the opposite side wall of the seat support 12. The first pin 40 is slideably supported in the first guide slot 20 formed in the side wall 16 of the base 11. The first pin 40 is slideably supported in the first guide slot 21 formed in the opposite side wall 17 of the base 11. The first guide slots 20 and 21 are respectively formed as linear guide slots. I.e., the first guide slots 20 and 21 have a longitudinal center line which extends linearly from one longitudinal end of the first guide slot to the opposite longitudinal end of the first guide slot.

The boundary of the first guide slots 20 and 21 respectively has linear portions, extending parallel to the longitudinal axis of the respective linear guide slot 20 or 21. A first keyed sleeve 22 supports the first pin 40 in the first linear guide slot 20. The first keyed sleeve 22 has planar outer portions abutting on the linear boundary portions of the first guide slot 20. The first pin 40 is received in a through opening formed in the first keyed sleeve 22. The first pin 40 may be received in the through opening of the first keyed sleeve 22 so as to be rotatable relative to the first keyed sleeve 22. This arrangement allows the first pin 40, received in the first keyed sleeve 22, to be displaced along the longitudinal axis of the first linear guide slot 20.

A first keyed sleeve 23 supports the first pin 40 in the first linear guide slot 21 provided on the other side wall 17 of the base 11. The configuration and coupling of the first keyed sleeve 23, the first linear guide slot 21 provided in the other side wall 17 and the first pin 40 correspond to the one of the first keyed sleeve 22, the first linear guide slot 20 and the first pin 40 explained above.

In the assembled state of the tilt mechanism 10, the seat support 12 is coupled to the back support 13 via a second coupling mechanism. A second pin 44 is attached to the seat support 12. The second pin 44 may be passed through the through opening 29 formed in the side wall 27 of the seat support. The second pin 44 is slideably supported in the second guide slot 36 formed in the side wing 31 of the back support 13. In the illustrated implementation, the second pin 44 does not extend across the full lateral width of the seat support 12. A separate second pin (not shown) is attached on the opposite side wall of the seat support, this latter second pin being slideably supported in the guide slot 37 formed in the side wing 32 of the back support 13. The second guide slots 36 and 37 are respectively formed as linear guide slots. I.e., the second guide slots 36 and 37 have a longitudinal center line which extends linearly from one longitudinal end of the second guide slot to the opposite longitudinal end of the second guide slot.

The boundary of the second guide slots 36 and 37 respectively has linear portions, extending parallel to the longitudinal axis of the respective linear guide slot 36 or 37. A second keyed sleeve 38 supports the second pin 44 in the second linear guide slot 36. The second keyed sleeve 38 has planar outer portions abutting on the linear boundary portions of the second guide slot 36. The second pin 44 is received in a through opening formed in the second keyed sleeve 38. The second pin 44 may be received in the through opening of the second keyed sleeve 38 so as to be rotatable relative to the second keyed sleeve 38. This arrangement allows the second pin 44, received in the second keyed sleeve 38, to be displaced along the longitudinal axis of the second linear guide slot 36.

A second keyed sleeve 39 supports another second pin (not shown) in the second linear guide slot 37 provided on the other side wing 32 of the back support 13. The configuration and coupling of the second keyed sleeve 39, the second linear guide slot 37 provided in the other side wing 32 and the other second pin correspond to the one of the second keyed sleeve 38, the second linear guide slot 36 and the second pin 44 explained above.

In the tilt mechanism 10, the seat support 12 is displaceably mounted to the base 11. A first coupling mechanism coupling the seat support 12 and the base 11 has a first linear guide slot, or a plurality of first linear guide slots, and a first pin, or a plurality of first pins, slideably supported therein. The back support 13 is pivotably coupled to the base 11. The back support 13 is further coupled to the seat support 12 via a second coupling mechanism, which has a second linear guide slot, or a plurality of second linear guide slots, and a second pin, or a plurality of second pins, slideably supported therein. As the seat support 12 and the back support 13 are not merely coupled by a pivot connection, the rear end of the seat support 12, and thus the rear end of the chair seat, is not constrained to perform a radial movement.

Further, the characteristics of the tilt mechanism 10 may be controlled by appropriately selecting the slope of the first linear guide slot(s) and of the second linear guide slot(s). For illustration, the weight compensation affect and the seat angular movement may be controlled by appropriately setting the slope of the first linear guide slot.

For illustration, by increasing the slope of the first guide slot provided in the base relative to the horizontal plane, i.e. relative to the plane extending parallel to the support plane of the chair when the tilt mechanism 10 is installed in the chair, the weight compensation affect may be increased while the seat angular movement may be reduced. In manufacture, the tilt mechanism 10 can be easily adapted to given customer requirements by forming the first linear guide slot and the second linear guide slot to have a desired direction. For illustration, the direction of the longitudinal axis of the first linear guide slot and the direction of the longitudinal axis of the second linear guide slot, relative to the horizontal plane when the mechanism is in the zero-tilt position, may be controlled to accommodate various customer needs and requirements imposed by the chair design.

The operation of the tilt mechanism 10 will be explained in more detail with reference to FIGS. 3-11.

Figure 3:
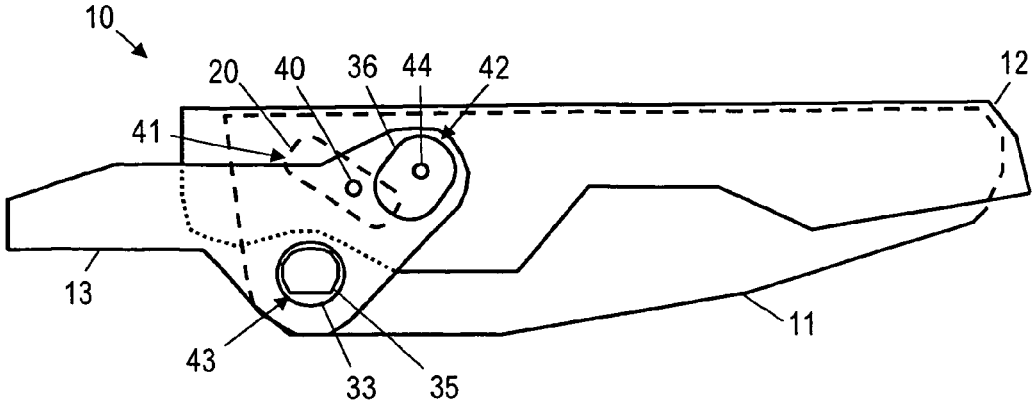
FIG. 3 is a schematic side view, also illustrating the position of hidden components, of a chair tilt mechanism according to an embodiment in the zero-tilt position.
Figure 4:
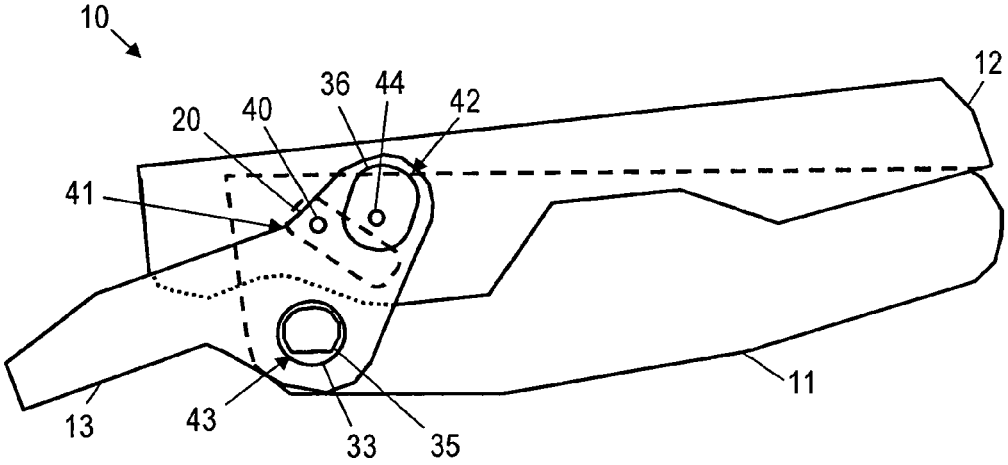
FIG. 4 is a schematic side view, also illustrating the position of hidden components, of the chair tilt mechanism of FIG. 3 in a position corresponding to a finite chair back tilt angle.

FIG. 3 shows a side view of the tilt mechanism 10 in the zero-tilt position. FIG. 4 shows a side view of the tilt mechanism 10 in a position in which the back is reclined. Portions of the seat support 12 hidden by the back support 13 are indicated by dotted lines. Portions of the base 11 hidden by the back support 13 or the seat support 12 are indicated by dashed lines. The center of the first pin is indicated at 40. The center of the second pin is indicated at 44. The first coupling mechanism is generally indicated at 41. The second coupling mechanism is generally indicated at 42.

As will be appreciated from FIGS. 3 and 4, the first coupling mechanism 41 and the second coupling mechanism 42 are generally arranged in a rearward portion of the tilt mechanism 10. The pivot coupling 43 for pivotably coupling the back support 13 and the base 11 is provided at a rear end of the base 11. The configuration of the first and second coupling mechanisms allows the first guide slot 20 and the second guide slot 36 to be partially overlapped.

In use of the tilt mechanism 10, the back support 13 is pivoted relative to the base 11 about the pivot coupling 43. When the back support 13 pivots relative to the base 11, the second linear slot 36 provided in the back support 13 is also pivoted relative to the base 11. This drives the second pin 44 along the longitudinal axis of the second linear guide slot 36.

With the second pin 44 being attached to the seat support 12, the change in orientation of the second guide slot 36 and the displacement of the second pin 44 along the longitudinal axis of the second guide slot 36 causes the first pin 40 to be displaced along the longitudinal axis of the first guide slot 20. The joint displacement of the first pin 40 along the longitudinal axis of the first linear guide slot 20 and of the second pin 44 along the longitudinal axis of the second linear guide slot 36 causes the seat support 12 to move relative to the base 11.

When the tilt mechanism 10 is installed in a chair, a reclining motion of the chair back will cause the second pin 44 to be displaced along the second guide slot 36 and the first pin 40 to be displaced along the first guide slot 20, resulting in a movement of the seat support 12 which is coordinated with the reclining motion of the chair back. The motion of the seat support 12 causes the chair seat directly coupled to the seat support 12 to be displaced in a corresponding manner, relative to the chair base assembly coupled to the base 11 of the tilt mechanism 10. The resulting movement of the chair seat, and in particular of the rear end of the chair seat, may be defined by suitably selecting the slope of the first and second guide slots.

Figure 5:
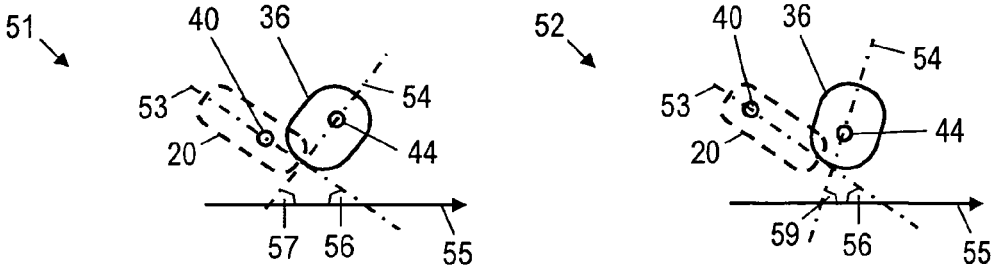
FIG. 5 is a detail view illustrating the configuration of a first coupling mechanism and of a second coupling mechanism in FIGS. 3 and 4, respectively.

FIG. 5 illustrates the state of a first coupling mechanism and of a second coupling mechanism in greater detail when a tilt mechanism is brought from a zero-tilt position to a position corresponding to a finite chair back tilt angle. At 51, the configuration of the coupling mechanisms is illustrated for the zero-tilt position of the tilt mechanism. At 52, the configuration of the coupling mechanisms is illustrated for a tilted position in which the back support 13 has been pivoted relative to the basis.

In the zero-tilt position indicated at 51, a longitudinal axis 53 of the first linear guide slot 20 slopes downwardly in a forward direction 55 of the tilt mechanism. The longitudinal axis 53 of the first linear guide slot 20 encloses an angle 56 with the horizontal plane. A longitudinal axis 54 of the second linear guide slot 36 slopes upwardly in the forward direction 55 of the tilt mechanism. The longitudinal axis 54 of the second linear guide slot 36 encloses an angle 57 with the horizontal plane.

Upon transition to the tilted position indicated at 52, the first pin 40 is driven along the longitudinal axis 53 of the first linear guide slot 20. The second pin 44 is driven along the longitudinal axis 54 of the second linear guide slot 36, while the direction of the longitudinal axis 54 of the second linear guide slot 36 is altered by tilting the back support. In the tilted position, the longitudinal axis 54 of the second linear guide slot 36 still slopes upwardly in the forward direction 55. In the tilted position, the longitudinal axis 54 of the second linear guide slot 36 encloses an angle 59 with the horizontal plane which is increased as compared to the zero-tilt position indicated at 51.

Various arrangements of the first and second linear guide slots may be implemented. For illustration, the longitudinal axis 53 of the first linear guide slot 20 is illustrated to enclose an angle 56 of slightly more than 30°, e.g. of 32°, with the horizontal plane. If this angle is made larger, i.e. if the first guide slot 20 is arranged so as to extend steeper relative to the horizontal plane, the weight compensation affect may be increased. If the angle 56 is selected to be smaller, the weight compensation affect may be decreased.

The longitudinal axis 54 of the second linear guide slot 36 may be made to pivot by approximately 20° from the zero-tilt position to the full-tilt position. By altering the angle 57 between the longitudinal axis 54 of the second linear guide slot 36 and the horizontal plane, for the zero-tilt position of the mechanism, the ride characteristics of the tilt mechanism 10 may be adapted.

By adapting the slope of the first linear guide slot 20 and the second linear guide slot 36, the requirements imposed by different types of chairs in which the tilt mechanism is to be used may be readily accommodated upon manufacture of the tilt mechanism.

FIGS. 6-11 illustrate the operation of the chair tilt mechanism of FIG. 2 in more detail.

Figure 6:
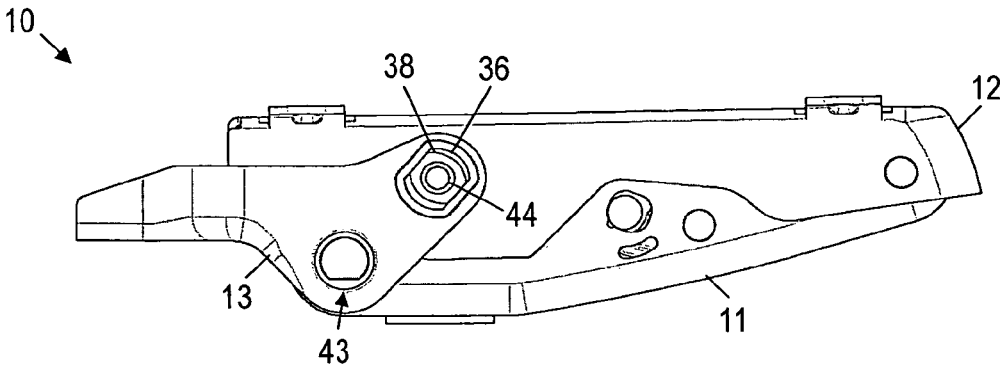
FIG. 6 is a side view of the chair tilt mechanism of FIG. 2 in a zero-tilt position.
Figure 7:
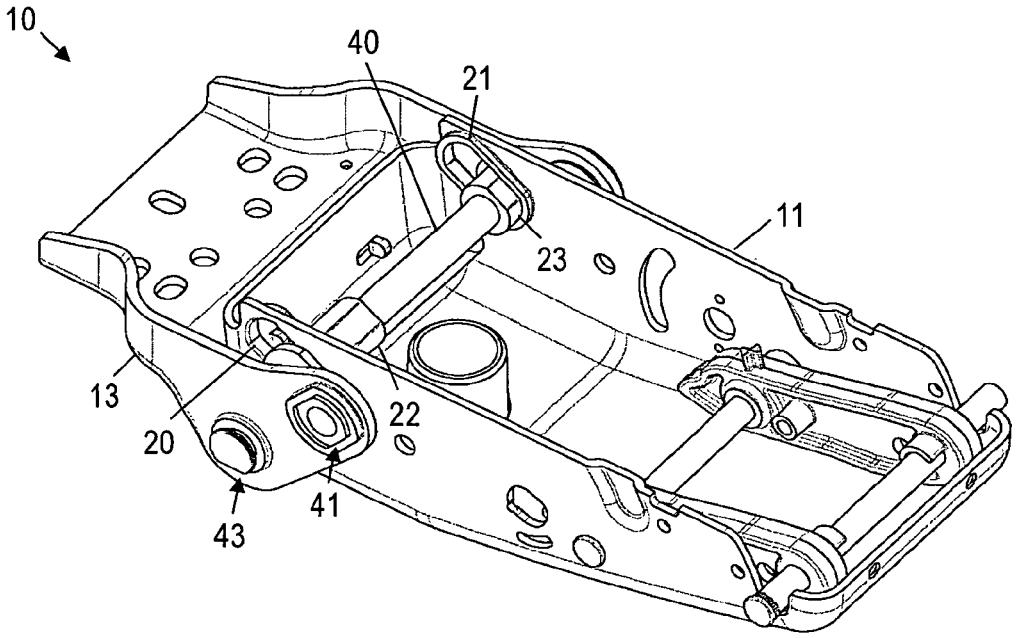
FIG. 7 is a partially broken away perspective view of the chair tilt mechanism of FIG. 2 in the zero-tilt position.

FIG. 6 shows a side view of the chair tilt mechanism in a zero-tilt position. FIG. 7 shows a perspective view of the chair tilt mechanism in the zero-tilt position, with the seat support 12 removed.

In the zero-tilt position, the first pin 40 is positioned at its lowermost position in the first linear guide slot 21. The keyed sleeve 23, which supports the first pin 40 in the first linear guide slot 21, may abut on one end of the first linear guide slot 21 in the zero-tilt state.

Figure 8:
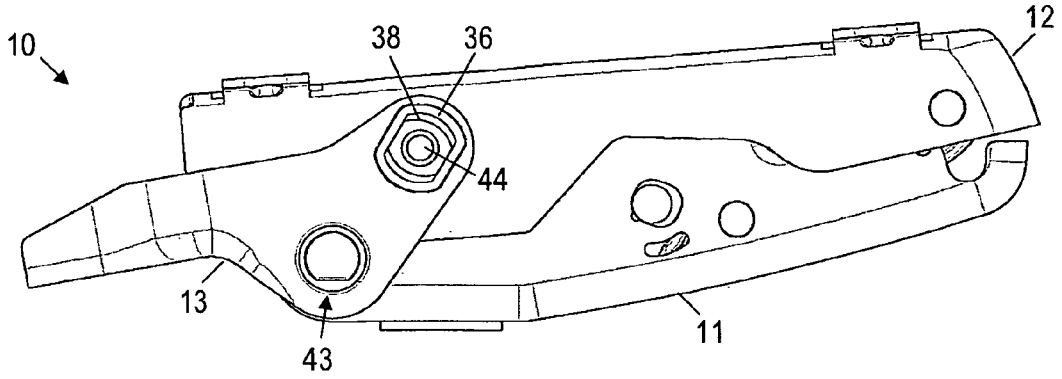
FIG. 8 is a side view of the chair tilt mechanism of FIG. 2 in an intermediate tilt position.
Figure 9:
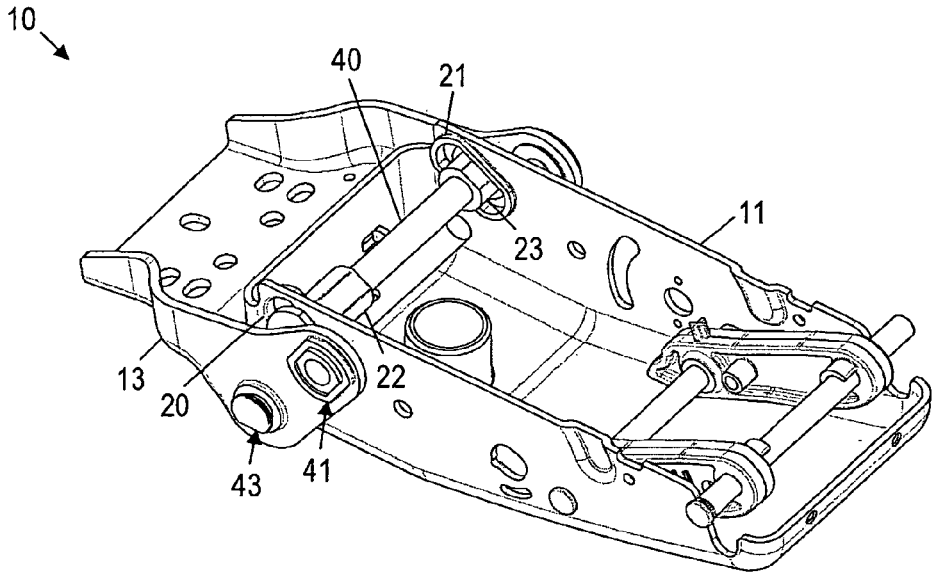
FIG. 9 is a partially broken away perspective view of the chair tilt mechanism of FIG. 2 in the intermediate tilt position.

FIG. 8 shows a side view of the chair tilt mechanism in an intermediate tilt position. FIG. 9 shows a perspective view of the chair tilt mechanism in the intermediate tilt position, with the seat support 12 removed.

In the intermediate tilt position, the back support 13 has been pivoted about the pivot 43 through an angle, relative to the zero-tilt position. This causes the second pin 44 to travel along the longitudinal axis of the second guide hole 36, jointly with the keyed sleeve 38 in which it is received. Similarly, when the back support 13 pivots about the pivot 43, the first pin 40 travels along the first linear guide slot 21, jointly with the keyed sleeve 23 in which it is received. In the intermediate tilt position shown in FIGS. 8 and 9, the keyed sleeve 23 is spaced from both longitudinal ends of the first linear guide slot 21. The displacement of the first pin along the first linear guide slot and of the second pin along the second linear guide slot causes the seat support 12 to be moved relative to the seat base 11, as best seen in FIG. 8.

Figure 10:
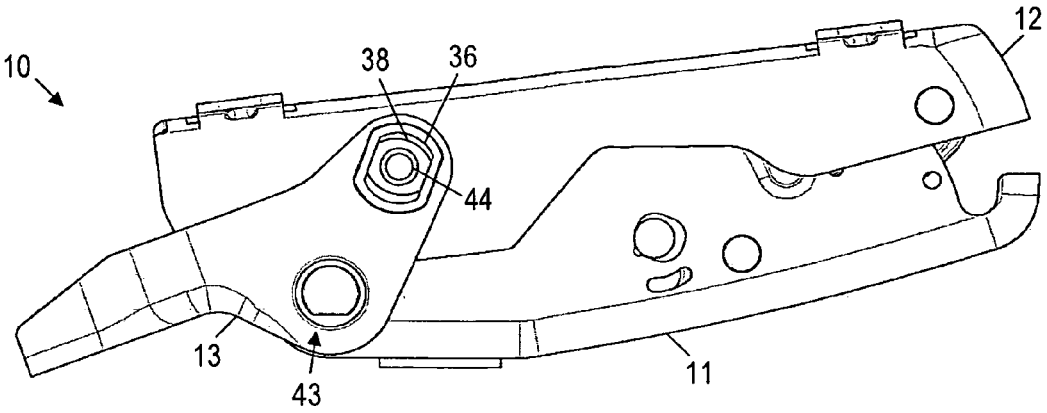
FIG. 10 is a side view of the chair tilt mechanism of FIG. 2 in a full-tilt position.
Figure 11:
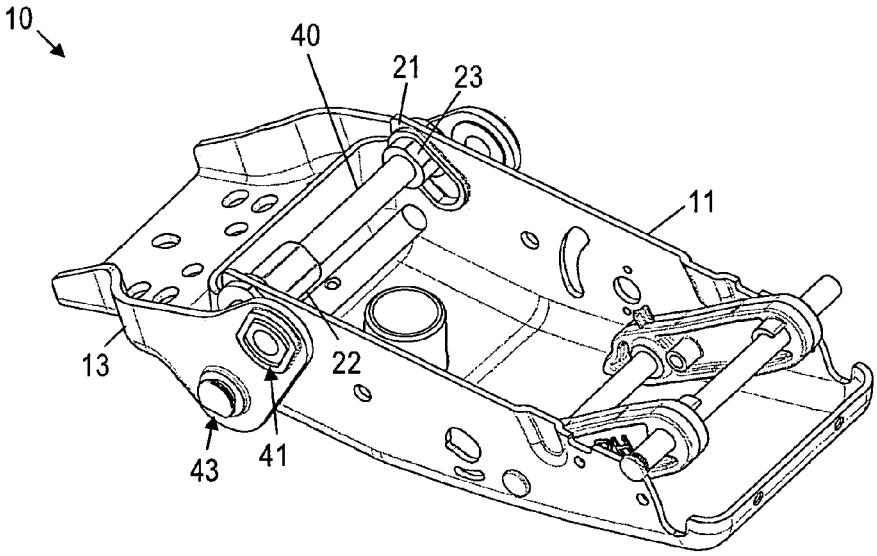
FIG. 11 is a partially broken away perspective view of the chair tilt mechanism of FIG. 2 in the full-tilt position.

FIG. 10 shows a side view of the chair tilt mechanism in a full-tilt position. FIG. 11 shows a perspective view of the chair tilt mechanism in the full-tilt position, with the seat support 12 removed.

In the full-tilt position, the back support 13 has been further pivoted about the pivot 43 through an angle, relative to the zero-tilt position. This causes the second pin 44 to travel along the longitudinal axis of the second guide hole 36, jointly with the keyed sleeve 38 in which it is received. Similarly, when the back support 13 continues to pivot about the pivot 43, the first pin 40 continues to travel along the first linear guide slot 21, jointly with the keyed sleeve 23 in which it is received. In the full-tilt position shown in FIGS. 10 and 11, the keyed sleeve 23 may come into abutment with the upper end of the first linear guide slot 21.

The second pin 44 may, but does not need to travel along the longitudinal axis of the second guide slot 36 monotonously in one direction when the back support 13 is reclined from its foremost to its rearmost position. For illustration, the second pin 44 may travel along the longitudinal axis of the second guide slot 36 in one direction while the tilt mechanism is brought from a zero-tilt position to an intermediate tilt position by pivoting the back support 13, and the second pin 44 may travel back along the longitudinal axis of the second guide slot 36 in the opposite direction when the back support 13 continues to pivot relative to the base 11, thereby bringing the tilt mechanism 10 from the intermediate tilt position to the full-tilt position.

While the state of the first and second coupling mechanisms at respectively one lateral side of the tilt mechanism is illustrated in detail in FIGS. 6-11, the first and second coupling mechanisms provided on the opposite lateral sides of the tilt mechanism have states corresponding to the ones illustrated in FIGS. 6-11. For illustration, the position of the first pin 40 and of the first keyed sleeve 22 relative to the first guide slot 20 formed in the side wall 16 of the base 11 will generally correspond to the position of the first pin 40 and of the first keyed sleeve 23 relative to the first guide slot 21 formed in the opposite side wall 17 of the base. Similarly, the position of the second pin and of the second keyed sleeve 39 relative to the second guide slot 37 formed in the side wing 32 of the back support 13 will generally correspond to the position of the second pin 44 and of the second keyed sleeve 38 relative to the second guide slot 36 formed in the side wing 31 of the back support 13.

While tilt mechanisms 10 according to embodiments have been described in detail with reference to the drawings, modifications thereof may be implemented in further embodiments. For illustration, additional mechanisms may be integrated into the tilt mechanism 10 to implement additional functionalities. Such mechanisms may include a mechanism for adjusting a restoring force of the chair back, or similar.

For further illustration, while tilt mechanisms have been described in which a single first pin is slideably supported in two first linear guide slots formed on the base, two separate first pins may be provided in further embodiments. While tilt mechanisms have been described in which two separate second pins are respectively slideably supported in two second linear guide slots formed on the back support, one second pin slideably supported in both second linear guide slots may be provided in yet further embodiments.

For further illustration, while tilt mechanisms have been described in which the first coupling mechanism coupling the seat support with the base includes a first pin attached to the seat support and a first linear guide slot formed in the side wall(s) of the base, the first pin may be attached to the base and the first linear guide slot(s) may be formed on the seat support in further embodiments.

For further illustration, while tilt mechanisms have been described in which the second coupling mechanism coupling the seat support with the back support includes a second pin attached to the seat support and a second linear guide slot formed in the side wing(s) of the back support, the second pin may be attached to the back support and the second linear guide slot(s) may be formed in the side wall(s) of the seat support in further embodiments.

For further illustration, while tilt mechanisms have been described in which the first linear guide slot is formed as a through slot, the first linear guide slot(s) may also be formed as a blind slot. Alternatively or additionally, while tilt mechanisms have been described in which the second linear guide slot is formed as a through slot, the second linear guide slot(s) may also be formed as a blind slot.

While exemplary embodiments have been described in the context of office-type chairs, the tilt mechanisms and chairs according to embodiments of the invention are not limited to this particular application. Rather, embodiments of the invention may be employed to effect a coordinated motion of a chair back and chair seat in a wide variety of chairs.

The invention claimed is:

1. A tilt mechanism for a chair, configured to effect a coordinated movement of a chair seat and chair back, said tilt mechanism comprising:

a base, a first support configured to support a chair seat and displaceably mounted to said base, a second support configured to support a chair back and pivotably coupled to said base, a first coupling mechanism coupling said first support to said base and comprising a first linear guide slot and a first pin slideably supported in said first linear guide slot, said first linear guide slot being provided on one of said base and said first support, and said first pin being attached to the other one of said base and said first support, and a second coupling mechanism coupling said second support to said first support and comprising a second linear guide slot and a second pin slideably supported in said second linear guide slot, said second linear guide slot being provided on one of said first support and said second support, and said second pin being attached to the other one of said first support said second support, said tilt mechanism being configured such that pivoting said second support relative to said base causes said second pin to be displaced along said second linear guide slot and said first pin to be displaced along said first linear guide slot, and said first coupling mechanism and said second coupling mechanism being arranged such that a longitudinal axis of said first pin is parallel to a longitudinal axis of said second pin.

2. The tilt mechanism of claim 1, configured such that an orientation of said second linear guide slot relative to said base changes when said second support pivots relative to said base.

3. The tilt mechanism of claim 1, said first linear guide slot being formed in a portion of said one of said base and said first support defining a first plane, and said second linear guide slot being formed in a portion of said one of said first support and said second support defining a second plane, said first plane and said second plane extending parallel to each other.

4. The tilt mechanism of claim 1, said base having a side wall portion extending transverse to said longitudinal axis of said first pin, one of said first pin and said first linear guide slot being provided on said side wall portion of said base.

5. The tilt mechanism of claim 4, said second support having a wing portion extending transverse to said longitudinal axis of said first pin, one of said second pin and said second linear guide slot being provided on said wing portion of said second support.

6. The tilt mechanism of claim 4, said first support having a side wall portion extending transverse to said longitudinal axis of said first pin, the other one of said first pin and said first linear guide slot being provided on said side wall portion of said first support.

7. A tilt mechanism for a chair, configured to effect a coordinated movement of a chair seat and chair back, said tilt mechanism comprising:

a base, a first support configured to support a chair seat and displaceably mounted to said base, a second support configured to support a chair back and pivotably coupled to said base, a first coupling mechanism coupling said first support to said base and comprising a first linear guide slot and a first pin slideably supported in said first linear guide slot, said first linear guide slot being provided on one of said base and said first support, and said first pin being attached to the other one of said base and said first support, and a second coupling mechanism coupling said second support to said first support and comprising a second linear guide slot and a second pin slideably supported in said second linear guide slot, said second linear guide slot being provided on one of said first support and said second support, and said second pin being attached to the other one of said first support said second support, said tilt mechanism being configured such that pivoting said second support relative to said base causes said second pin to be displaced along said second linear guide slot and said first pin to be displaced along said first linear guide slot, and said first linear guide slot being provided on said base and said first pin being fixed to said first support.

8. The tilt mechanism of claim 7, said first linear guide slot being provided on said base in proximity to an end of said base at which said second support is pivotably coupled to said base.

9. A tilt mechanism for a chair, configured to effect a coordinated movement of a chair seat and chair back, said tilt mechanism comprising:

a base, a first support configured to support a chair seat and displaceably mounted to said base, a second support configured to support a chair back and pivotably coupled to said base, a first coupling mechanism coupling said first support to said base and comprising a first linear guide slot and a first pin slideably supported in said first linear guide slot, said first linear guide slot being provided on one of said base and said first support, and said first pin being attached to the other one of said base and said first support, and a second coupling mechanism coupling said second support to said first support and comprising a second linear guide slot and a second pin slideably supported in said second linear guide slot, said second linear guide slot being provided on one of said first support and said second support, and said second pin being attached to the other one of said first support said second support, said tilt mechanism being configured such that pivoting said second support relative to said base causes said second pin to be displaced along said second linear guide slot and said first pin to be displaced along said first linear guide slot, and said second linear guide slot being provided on said second support and said second pin being fixed to said first support.

10. A tilt mechanism for a chair, configured to effect a coordinated movement of a chair seat and chair back, said tilt mechanism comprising:

a base, a first support configured to support a chair seat and displaceably mounted to said base, a second support configured to support a chair back and pivotably coupled to said base, a first coupling mechanism coupling said first support to said base and comprising a first linear guide slot and a first pin slideably supported in said first linear guide slot, said first linear guide slot being provided on one of said base and said first support, and said first pin being attached to the other one of said base and said first support, and a second coupling mechanism coupling said second support to said first support and comprising a second linear guide slot and a second pin slideably supported in said second linear guide slot, said second linear guide slot being provided on one of said first support and said second support, and said second pin being attached to the other one of said first support said second support, said tilt mechanism being configured such that pivoting said second support relative to said base causes said second pin to be displaced along said second linear guide slot and said first pin to be displaced along said first linear guide slot, and said tilt mechanism defining a forward direction of said chair, one of said first linear guide slot and said second linear guide slot being sloped upwardly relative to said forward direction and the other one of said first linear guide slot and said second linear guide slot being sloped downwardly relative to said forward direction when said tilt mechanism is in a zero-tilt position.

11. The tilt mechanism of claim 10, said one of said first linear guide slot and said second linear guide slot altering its angle relative to said forward direction and remaining sloped upwardly relative to said forward direction when said second support pivots relative to said base.

12. The tilt mechanism of claim 1, A tilt mechanism for a chair, configured to effect a coordinated movement of a chair seat and chair back, said tilt mechanism comprising:

a base, a first support configured to support a chair seat and displaceably mounted to said base, a second support configured to support a chair back and pivotably coupled to said base, a first coupling mechanism coupling said first support to said base and comprising a first linear guide slot and a first pin slideably supported in said first linear guide slot, said first linear guide slot being provided on one of said base and said first support, and said first pin being attached to the other one of said base and said first support, and a second coupling mechanism coupling said second support to said first support and comprising a second linear guide slot and a second pin slideably supported in said second linear guide slot, said second linear guide slot being provided on one of said first support and said second support, and said second pin being attached to the other one of said first support said second support, said tilt mechanism being configured such that pivoting said second support relative to said base causes said second pin to be displaced along said second linear guide slot and said first pin to be displaced along said first linear guide slot, and said first coupling mechanism comprising two first linear guide slots provided on opposing side walls of one of said base and said first support, and said second coupling mechanism comprising two second linear guide slots provided on opposing sides of one of said first support and said second support.

13. A chair, comprising:

a chair base assembly, a chair seat, a chair back, and a tilt mechanism according to claim 1, said base-of said tilt mechanism being coupled to said chair base assembly, said chair seat being supported by said first support and said chair back being supported by said second support.

14. A tilt mechanism for a chair, configured to effect a coordinated movement of a chair seat and chair back, said tilt mechanism comprising:

a base, a first support configured to support a chair seat and displaceably mounted to said base, a second support configured to support a chair back and pivotably coupled to said base, a first coupling mechanism coupling said first support to said base and comprising a first linear guide slot provided on said base, and a second coupling mechanism coupling said second support to said first support and comprising a second linear guide slot provided on said second support, said tilt mechanism defining a forward direction of said chair, said second linear guide slot being sloped upwardly in said forward direction such that a forward end of said second linear guide slot is located higher than a rearward end of said second linear guide slot when said tilt mechanism is in a zero-tilt position.

15. The tilt mechanism of claim 14, said first linear guide slot being sloped downwardly relative to said forward direction when said tilt mechanism is in a zero-tilt position.

16. The tilt mechanism of claim 14, said second linear guide slot altering its angle relative to said forward direction and remaining sloped upwardly relative to said forward direction when said second support pivots relative to said base.

17. A chair, comprising:

a chair base assembly, a chair seat, a chair back, and a tilt mechanism according to claim 14, said base of said tilt mechanism being coupled to said chair base assembly, said chair seat being supported by said first support and said chair back being supported by said second support.

* * * * *